US006224728B1

(12) United States Patent
Oborny et al.

(10) Patent No.: US 6,224,728 B1
(45) **Date of Patent: *May 1, 2001**

(54) VALVE FOR FLUID CONTROL

(75) Inventors: Michael C. Oborny, Albuquerque, NM (US); Phillip H. Paul, Livermore, CA (US); Kenneth R. Hencken, Pleasanton, CA (US); Gregory C. Frye-Mason, Cedar Crest; Ronald P. Manginell, Albuquerque, both of NM (US)

(73) Assignee: Sandia Corporation, Livermore, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/373,872

(22) Filed: Aug. 13, 1999

Related U.S. Application Data

(63) Continuation-in-part of application No. 09/057,017, filed on Apr. 7, 1998, now Pat. No. 6,019,882.

(51) Int. Cl.[7] ..... C12Q 1/68

(52) U.S. Cl. ..... 204/450; 204/600; 204/647; 204/648; 417/52

(58) Field of Search ..... 204/450, 600, 204/647, 648; 417/52

(56) References Cited

U.S. PATENT DOCUMENTS 5,375,979 12/1994 Trah ..... 417/52
6,019,882 * 2/2000 Paul et al. ..... 204/450

* cited by examiner

*Primary Examiner*—Arun S. Phasge
(74) *Attorney, Agent, or Firm*—Donald A. Nissen

(57) ABSTRACT

A valve for controlling fluid flows. This valve, which includes both an actuation device and a valve body provides: the ability to incorporate both the actuation device and valve into a unitary structure that can be placed onto a microchip, the ability to generate higher actuation pressures and thus control higher fluid pressures than conventional microvalves, and a device that draws only microwatts of power. An electrokinetic pump that converts electric potential to hydraulic force is used to operate, or actuate, the valve.

9 Claims, 2 Drawing Sheets

VALVE FOR FLUID CONTROL

CROSS-REFERENCE TO RELATED APPLICATIONS

This application is a Continuation-in-Part of prior co-pending U.S. patent application Ser. No. 09/057,017 filed on Apr. 7, 1998 now U.S. Pat. No. 6,019,882 entitled ELECTROKINETIC HIGH PRESSURE HYDRAULIC SYSTEM from which priority is claimed.

STATEMENT OF GOVERNMENT INTEREST

This invention was made with Government support under contract no. DE-AC04-94AL85000 awarded by the U.S. Department of Energy to Sandia Corporation. The Government has certain rights in the invention.

BACKGROUND OF THE INVENTION

This invention pertains generally to valves for controlling fluid flow and particularly to microvalves that use electrokinetic pump actuation for fluid flow control in microfluidic systems.

Recent advances in device miniaturization have led to the development of microfluidic devices that are designed, in part, to perform a multitude of chemical and physical process. Typical applications include analytical and medical instrumentation, and industrial process control equipment. Microvalves are an important component of the microfluidic systems used in these applications.

Although there are numerous micro-fabricated valve designs that use a wide variety of actuation mechanisms, only two of these designs are incorporated in commercially available microvalves, with thermopneumatic expansion being used as the actuation mechanism in one design and a shape memory alloy diaphragm and bias spring in the other. However, these microvalves suffer from the fact that they consume relatively large amounts of power during operation, typically between 200 and 1500 mW depending upon the design. This high power consumption can be a significant disadvantage if power must be supplied by batteries or the microvalve is placed on a microchip. Moreover, valves using the aforementioned actuation mechanisms can only generate modest actuation pressures.

What is needed is a microvalve that can be used for microfluidic systems that requires significantly less power to operate, can exert larger actuation pressures than can be presently developed by conventional microvalves, is suitable for use on a microchip, and provides both rapid "on" and "off" actuation.

SUMMARY OF THE INVENTION

The present invention is directed to a valve that can generate actuation pressures in excess of 8000 psi and can be used for controlling fluid flow, both gas and liquid, particularly in microfluidic systems. These novel microvalves can be operated, generally, at a power of less than about 10 mW, and particularly at a power of less than about 1 mW.

In contrast to prior art microvalves, the present valve employs an electrokinetic pump to generate the pressure required to operate, or actuate, the valve itself. The use of an electrokinetic pump to operate the microvalve provides several significant advantages over conventional microvalves. Among these is the ability to incorporate the actuation device and valve into a unitary structure that can be placed onto a microchip, the ability to generate higher actuation pressures and thus control higher fluid pressures than conventional actuation means, and the requirements for only microwatts of power for activation. Further, by employing the hydraulic pressure developed by an electrokinetic pump to operate the microvalve, it is now possible to contemplate radically different microvalve designs.

BRIEF DESCRIPTION OF THE DRAWINGS

The accompanying drawings, which are incorporated in and form part of the specification, illustrate the present invention and, together with the description, explain the invention. In the drawings like elements are referred to by like numbers.

DETAILED DESCRIPTION OF THE INVENTION

The present invention is a novel valve for controlling fluid flows that provides: 1) the ability to incorporate the actuation device and valve into a unitary structure that can be placed onto a microchip, 2) the ability to generate higher actuation pressures and thus control higher fluid pressures than conventional microvalves, and 3) a device that draws only microwatts of power. An electrokinetic pump that converts electric potential to hydraulic force is used to operate, or actuate, the microvalve. In order to understand the present invention better, the following introductory discussion is provided.

It has been demonstrated that it is possible to convert electric potential to hydrodynamic force and, by means of a process called electrokinetic pumping, to produce hydraulic pressures at least as great as 10,000 psi. The electrokinetic pump or EKP, comprises at least one tube or flow channel, that can be a capillary or micro-fabricated channel, forming a fluid passageway. The flow channel has a porous dielectric material disposed therein and contains an electrolyte in contact with one or more pair of spaced electrodes. The porous dielectric medium can include small particles, high surface area structures fabricated within the microchannel, and porous materials, such as porous organic polymer materials. An electric potential can be applied to the electrodes by means of a conventional power supply or batteries and the electric potential can assume various forms suitable to the operation of the system described herein, such as having a varying amplitude, shape, and period. The electrolyte, which is in contact with the spaced electrodes, can be an aqueous, or an organic liquid or mixtures thereof. The electric field applied across the EKP by the spaced electrodes will cause the electrolyte contained in the porous dielectric medium to flow and, when presented with an external flow resistance can create pressures of thousands of psi at the down stream end of the EKP. The flowrate of the electrolyte is proportional to the magnitude of the applied electric field (V/m applied across the EKP) and the pressure generated is proportional to the voltage across the device. The direction of flow of the electrolyte is determined by both the nature of the electrochemical interaction between the porous dielectric medium and the electrolyte, and the polarity of the applied electric potential. A detailed discussion of the theory and operation of the electrokinetic pumping process can be found in prior co-pending U.S. patent applications Ser. No. 08/882,725 filed on Jun. 25, 1997 and Ser. No. 09/057,017 filed on Apr. 7, 1998, both entitled ELECTROKINETIC HIGH PRESSURE HYDRAULIC SYSTEM, assigned to the same assignee, and incorporated herein by reference in their entirety.

Figure 1:
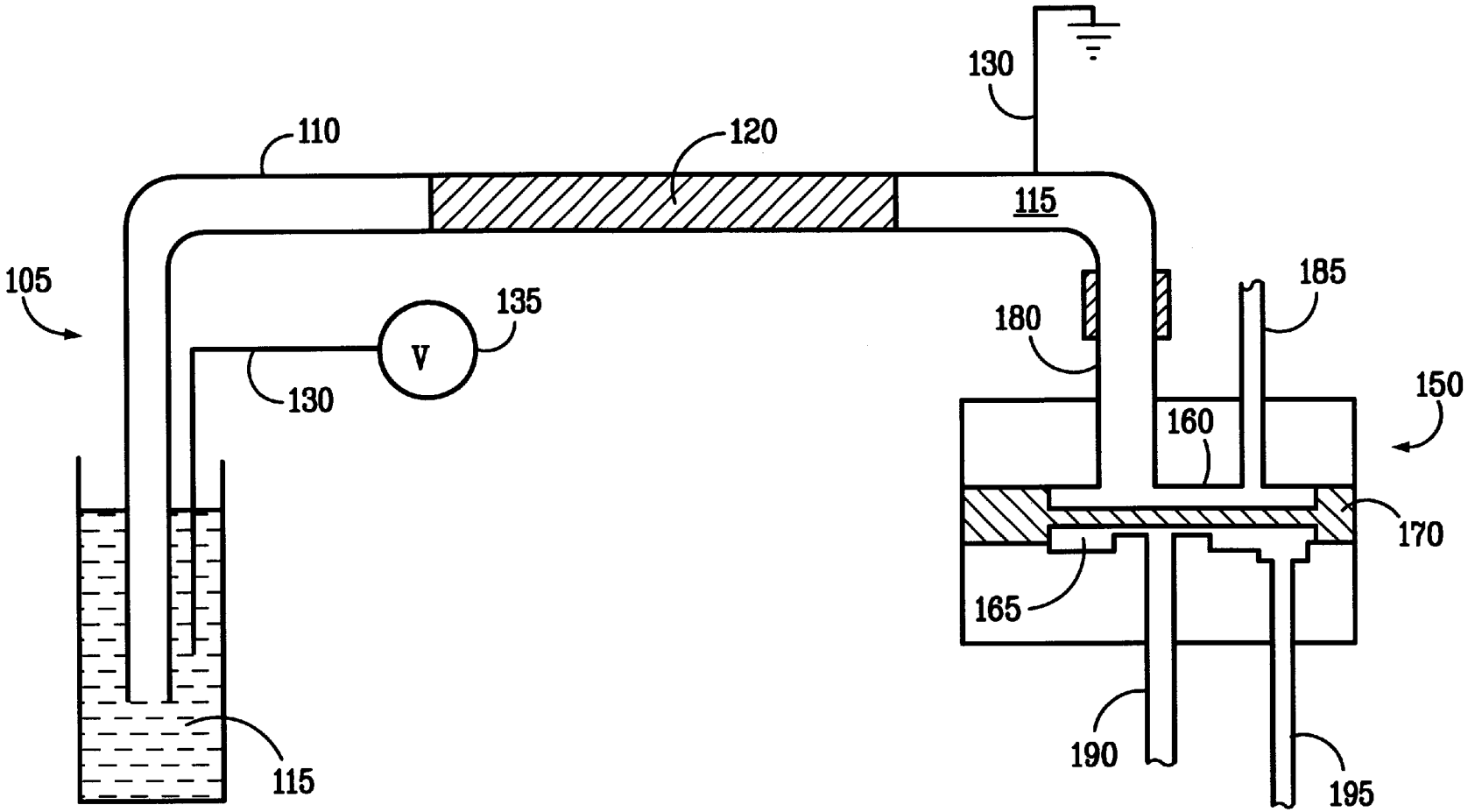
FIG. 1 illustrates a normally-open embodiment of the present valve.

Referring now to FIG. 1, which shows one embodiment of the valve of the present invention for controlling the flow of a fluid, valve 100 comprises generally an electrokinetic pump 105 and a valve body 150. As set forth above, electrokinetic pump 105 generally consists of at least one tube or channel 110, having an inlet and outlet, that can be a capillary channel or microchannel, that forms a fluid passageway containing an electrolyte 115 and having a porous dielectric medium 120 disposed therein between one or more pair of spaced electrodes 130. Porous dielectric medium 120 can include small particles, high surface area structures fabricated within the microchannel, or porous materials, such as porous organic polymer materials. An electric potential 135 is applied between electrodes 130 in contact with electrolyte 115 to cause the electrolyte to move in the microchannel by electroosmotic flow. Electrolyte 115 can be an aqueous or an organic liquid or mixtures thereof.

Valve body 150 is provided with two chambers, a fluid chamber 165 and an actuator chamber 160, joined together. The fluid and actuator chambers can be fabricated from a glass, silicon, or a suitable polymeric material. A fluid tight, flexible member 170, serving as a partition or diaphragm, separates the two chambers. Flexible member 170 is preferably made from a material, such as silicon, Kapton, or a polymeric material, that is compatible with the fluids that are contained in chambers 160 and 165 and is flexible by virtue of its composition or mechanical design. Actuator chamber 160 can be provided with an inlet port 180 and can have an outlet port 185. The outlet of electrokinetic pump 105 can be connected to inlet port 180. Prior to operating valve 150, actuator chamber 160 can be filled with electrolyte from electrokinetic pump 105, or any other fluid compatible with operation of the electrokinetic pump, by opening a shut-off valve (not shown) included in outlet port 185. A shut-off valve (not shown) closes outlet port 185 during device operation. Fluid chamber 165 can be similarly provided with an inlet port 190 and an outlet port 195 for ingress and egress of a fluid stream, either liquid or gas.

The flow of a fluid stream is controlled by applying hydraulic pressure, generated by the action of electrokinetic pump 105 through inlet port 180, to flexible member 170 causing it to deform and close off fluid inlet port 190 and thereby stop fluid flow. To open valve 150, the polarity of the electric potential applied to electrokinetic pump 105 is reversed. It should be noted that because of the resistance of the dielectric medium to pressure driven flow, i.e., a pressure of several thousand psi can be required to force fluid through the dielectric medium, simply shutting the applied electric potential will generally not cause valve 150 to open. Moreover, because actuator chamber 160 and fluid chamber 165 are filled with fluid, the addition of only that amount of fluid necessary to cause displacement of flexible member 170 is required to stop fluid flow and thus, the response time of the valve can be very rapid.

In accordance with the present invention, a valve body comprising actuator and fluid chambers and an interposed diaphragm, similar to that shown in FIG. 1, was constructed to demonstrate its utility and to provide engineering data. The actuator and fluid chambers were each fabricated from Pyrex glass. A circular actuator chamber 4 mm in diameter and 150 $\mu$m high was machined in one piece of Pyrex glass and a circular fluid chamber of similar dimension was machined in a second piece of Pyrex glass. Silica microcapillary tubes provided inlet and outlet ports for both the actuator and fluid chambers. The inlet port for the fluid chamber can be located anywhere on the fluid chamber, but in this instance was centered directly below the center of the diaphragm separating the two chambers. The fluid chamber outlet port was connected to the fluid chamber by a short flow channel machined in the Pyrex glass body. A 75 $\mu$m thick silicon wafer provided the partition between the actuation and fluid chambers. A cavity 4 mm in diameter and 25 $\mu$m thick was etched into the silicon partition using an anisotropic wet-etch process, thereby, producing a circular diaphragm 4 mm in diameter and 50 $\mu$m thick. The valve body itself was fabricated by anodically bonding the two Pyrex glass bodies to the silicon partition material.

The inlet port of the actuator chamber was connected to the outlet port of an electrokinetic pump whose structure has been described above. In this particular instance, the porous dielectric material used in the electrokinetic pump was 4.5 $\mu$m non-porous silica beads and the electrolyte was acetonitrile.

A 10 psi nitrogen gas stream, having a flow rate of about 82 sccm, was applied to the fluid chamber inlet. A diaphragm actuation pressure of about 30–35 psi was sufficient for complete closure of the valve. This pressure was provided by applying about 5000 V dc to the electrokinetic pump connected to the actuator port of the valve body. Power consumption was measured to be 8 mW.

The surface area of the porous dielectric medium used in the electrokinetic pump plays a strong role in establishing the relationship between applied voltage and the hydraulic pressure produced by the electrokinetic pump. By increasing the surface area of the porous dielectric medium it has been shown that it is possible to apply a lower voltage to produce a given pressure. In the example above, the dielectric medium consisted of 4.5 $\mu$m non-porous silica beads. By substituting 0.5 $\mu$m non-porous silica beads for the dielectric medium, it has been shown that pressures as high as 500 psi can be attained with the application of about 20 V dc. Monolithic porous polymeric materials, having a high surface area, have also been shown to provide suitable dielectric material for an electrokinetic pump, and microvalve actuation voltages as low as 400 V dc have been demonstrated. Device power consumption at 400 V dc was about 16 $\mu$w.

Figure 2:
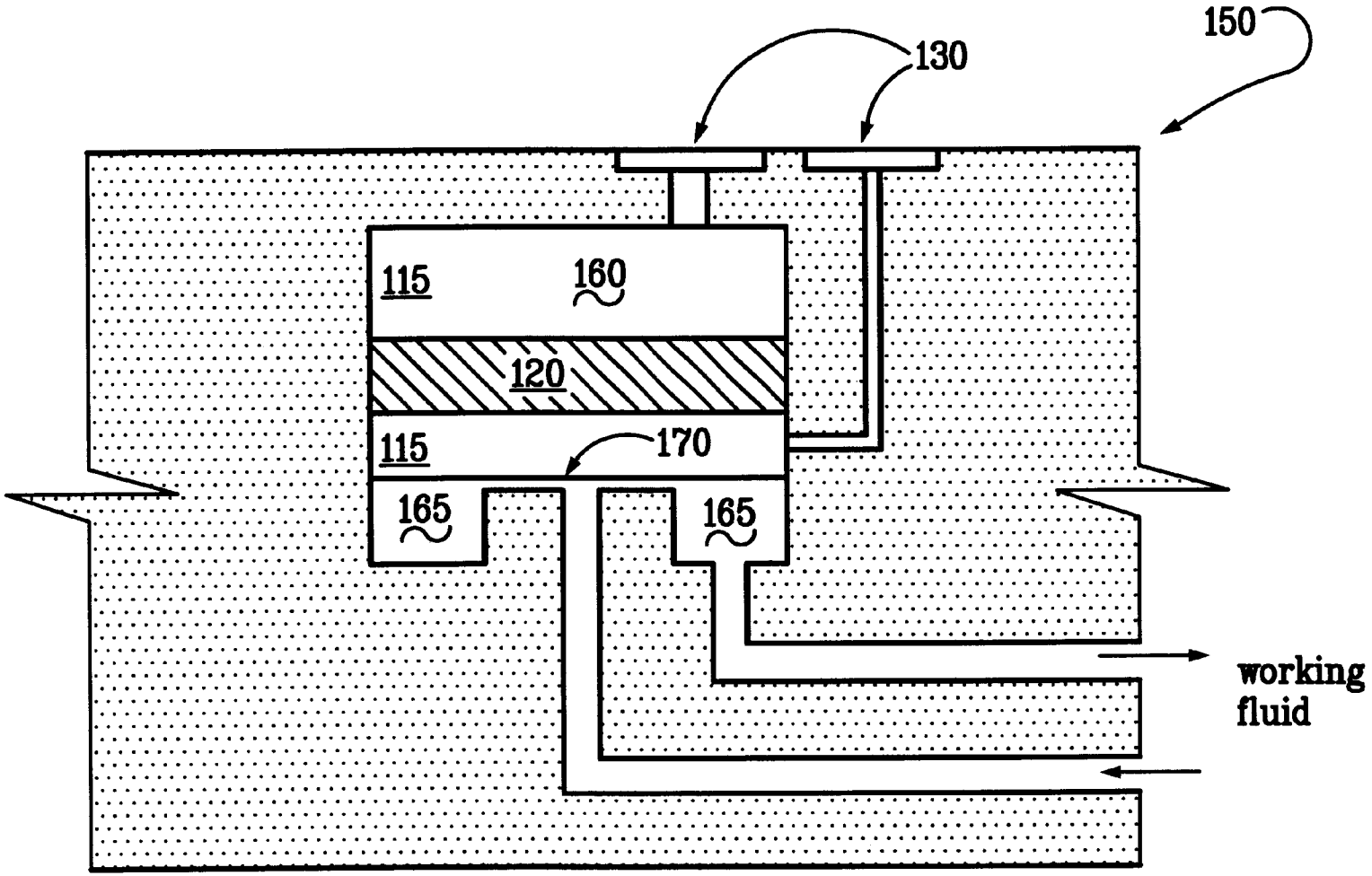
FIG. 2 shows a valve embodiment having an electrokinetic pump as an integral component of the valve body.

Another embodiment of the valve is shown by FIG. 2. As before, valve body 150 is provided with two chambers, a fluid chamber 165 and an actuator chamber 160 joined together with flexible member 170 interposed between and separating the two chambers. In this embodiment, however, the electrokinetic pump that provides the hydraulic force required to operate the valve is disposed within actuator chamber 160. As depicted in FIG. 2, actuator chamber 160 contains a porous dielectric medium 120 disposed between a pair of spaced electrodes 130. An electrolyte 115 fills actuator chamber 160. Opening and closing of the valve is as described above except that in this embodiment hydraulic force is applied directly to flexible member 170 rather than externally through an outlet port on the valve body. The incorporation of the electrokinetic pump into the valve body itself provides for a more compact design.

While the principle of operation of the present invention has been illustrated by two embodiments, it would be obvious to one skilled in the art that this same principle would apply to other types of valves and microvalves such as normally-closed and multiport valves. Consequently, it will be understood that the above described arrangement of apparatus and the methods pertaining thereto are merely illustrative of applications of the principles of this invention and many other embodiments and modifications can be made by those of skill in the art without departing from the spirit and scope of the invention as defined in the claims.

We claim:

1. A valve for controlling fluid flow, comprising:

an electrokinetic pump in combination with a valve body such that hydraulic pressure developed by said electrokinetic pump actuates a diaphragm contained within the valve body to open and close said valve.

2. The valve of claim 1, wherein the fluid is a liquid.

3. The valve structure of claim 1, wherein the valve body comprises:

a) a fluid chamber having at least one fluid inlet and one fluid outlet connected thereto;

b) an actuator chamber having at least one fluid inlet, wherein the output from the electrokinetic pump is connected to the fluid inlet of said actuator chamber; and c) a partition disposed between said fluid and actuator chambers sealingly separating said chambers and adapted to move in response to the hydraulic force generated by the electrokinetic pump to close or open the fluid inlet of the fluid chamber.

4. The valve of claim 3, wherein said fluid and actuator chambers are each fabricated from Pyrex glass.

5. The valve of claim 3, wherein said partition is silicon.

6. The valve of claim 1, wherein the valve body comprises:

a) a fluid chamber having at least one fluid inlet and one fluid outlet connected thereto;

b) an actuator chamber containing an electrolyte and a porous dielectric medium disposed between a pair of spaced electrodes that together comprise an electrokinetic pump; and c) a partition disposed between said fluid and actuator chambers sealingly separating said chambers and adapted to move in response to the hydraulic force generated by the electrokinetic pump to close or open the fluid inlet of the fluid chamber.

7. A solid substrate fabricated to define a valve structure disposed therein, the valve structure comprising; in combination, an electrokinetic pump joined to a valve body.

8. A method for controlling fluid flow, comprising:

connecting an electrokinetic pump to a valve body; and applying an electric potential to the electrokinetic pump to provide a hydraulic force to open or close the valve.

9. A method for controlling fluid flow, comprising:

incorporating an electrokinetic pump into a valve body; and applying an electric potential to the electrokinetic pump to provide a hydraulic force to open and close the valve.

* * * * *